US009849393B2

(12) United States Patent
Muraki

(10) Patent No.: US 9,849,393 B2
(45) Date of Patent: Dec. 26, 2017

(54) TOY TOP

(71) Applicant: TOMY COMPANY, LTD., Tokyo (JP)

(72) Inventor: Makoto Muraki, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/214,876

(22) Filed: Jul. 20, 2016

(65) Prior Publication Data

US 2017/0203218 A1 Jul. 20, 2017

(30) Foreign Application Priority Data

Jan. 19, 2016 (JP) ..... 2016-008042

(51) Int. Cl.
*A63H 33/00* (2006.01)
*A63H 1/00* (2006.01)

(52) U.S. Cl.
CPC ..... *A63H 1/00* (2013.01)

(58) Field of Classification Search
CPC ... A63H 1/00; A63H 1/02; A63H 1/04; A63H 33/042
USPC ..... D21/460
See application file for complete search history.

(56) References Cited

U.S. PATENT DOCUMENTS 2,112,182 A * 3/1938 Tintore ..... A63H 1/18 446/257
2,633,664 A * 4/1953 Neilson ..... A63H 1/18 446/257
3,029,077 A * 4/1962 Benkoe ..... A63F 9/0204 273/380
3,834,182 A * 9/1974 Trask ..... F16D 3/79 464/150
4,215,948 A * 8/1980 Horie ..... B43K 1/003 401/265
4,286,406 A * 9/1981 Sims ..... A63F 9/16 446/246
4,363,487 A * 12/1982 Hall ..... A63F 5/04 273/147
4,507,095 A * 3/1985 Lin ..... A63H 33/042 446/118
4,583,651 A * 4/1986 Ostberg ..... B65D 51/24 215/228
4,608,027 A * 8/1986 Klamer ..... A63H 29/00 446/457
D301,258 S * 5/1989 Olney ..... D21/460
(Continued)

FOREIGN PATENT DOCUMENTS

FR 2 862 233 5/2005
GB 1 255 715 12/1971
(Continued)

OTHER PUBLICATIONS

Japan Platform for Patent Information English Abstract, Publication No. 09-038337, published Feb. 10, 1997.
(Continued)

*Primary Examiner* — Aarti B Berdichevsky
*Assistant Examiner* — Urszula M Cegielnik
(74) *Attorney, Agent, or Firm* — Staas & Halsey LLP

(57) ABSTRACT

A toy top includes a body and a shaft unit. The shaft unit includes a spinning shaft which includes projections that extend downward at a lower end of the spinning shaft.

18 Claims, 7 Drawing Sheets

(56) References Cited

U.S. PATENT DOCUMENTS 4,886,273 A * 12/1989 Unger ..... A63F 9/12 273/127 A
4,932,918 A * 6/1990 Onoda ..... A63H 1/02 446/256
5,020,798 A * 6/1991 Yang ..... A63H 1/04 273/440
5,259,803 A * 11/1993 Lyman ..... A63H 31/00 446/103
5,324,226 A * 6/1994 McKay ..... A63H 1/16 446/236
5,996,998 A * 12/1999 Przybilla ..... A63H 1/00 273/147
6,398,615 B1 * 6/2002 Wu ..... A63H 33/40 40/440
6,520,827 B1 * 2/2003 Liu ..... A63H 1/00 446/124
6,582,273 B2 * 6/2003 Chen ..... A63H 5/00 446/175
6,604,979 B1 * 8/2003 Liu ..... A63H 1/02 446/256
6,648,718 B1 * 11/2003 Liu ..... A63H 1/00 446/256
6,666,743 B2 * 12/2003 Polare ..... A63H 1/24 446/242
6,764,375 B1 * 7/2004 Hsu ..... A63H 13/20 40/411
D497,396 S * 10/2004 Wechsler ..... D21/398
D563,492 S * 3/2008 Becker ..... D21/398
7,740,518 B2 * 6/2010 Elliott ..... A63F 9/16 273/126 R
8,282,437 B2 * 10/2012 Norman ..... A63H 3/003 446/236
8,469,363 B2 * 6/2013 Davis ..... A63F 9/0243 273/349
D723,631 S * 3/2015 Kanbar et al. ..... D21/488
2007/0021029 A1 * 1/2007 Weidetz ..... A63F 9/16 446/256
2011/0006479 A1 * 1/2011 Ujita ..... A63H 1/16 273/147
2011/0171876 A1 7/2011 Ujita et al.
2011/0256795 A1 * 10/2011 Ujita ..... A63H 1/00 446/264

FOREIGN PATENT DOCUMENTS

| | | |
|---|---|---|
| JP | 9-38337 | 2/1997 |
| JP | 9-131467 | 5/1997 |
| JP | 3106047 | 10/2004 |
| JP | 3109118 | 3/2005 |
| JP | 5756569 | 6/2015 |
| JP | 3200996 | 10/2015 |
| WO | WO 2015/062427 A1 | 5/2015 |

OTHER PUBLICATIONS

WIPO/PCT Publication English Abstract, Publication No. 2015/159368 (corresponds to Ref. AF), published Oct. 22, 2015.
Japan Platform for Patent Information English Abstract, Publication No. 09-131467, published May 20, 1997.
Office Action for Japanese Patent Application No. 2016-008042, dated Apr. 20, 2016.
Office Action for European Patent Application No. 16180124.6, dated Mar. 13, 2017.
Espacenet Bibliographic Data, French Publication No. 2 862 233, published May 20, 2005.
European Search Report dated Mar. 1, 2017 in corresponding European Patent Application No. 16180124.6.

* cited by examiner

TOY TOP

BACKGROUND OF THE INVENTION

1. Field of the Invention

The present invention relates to a toy top.

2. Description of Related Art

A battle game using toy tops has been known in which toy tops are brought into collision with each other, and a player wins the game when an opponent toy top is knocked out or a pop-out member disposed on the body of an opponent toy top is popped out by the resultant impact force (for example, see JP H09-38337A and Japanese Utility Model No. 3109118).

The toy top disclosed in JP H09-38337A or Japanese Utility Model No. 3109118 includes a pop-out member that is engaged with the toy top (toy top main body) via an elastic member. The toy top is configured such that when the engagement is broken by the impact force of a collision with another toy top, the pop-out member pops up by a biasing force of the elastic member.

In the toy tops as disclosed in JP H09-38337A or Japanese Utility Model No. 3109118, the result of the game depends on the performance determined by the weight and the outer peripheral shape thereof. For this reason, in recent years, there have been some toy tops with variable performance, which is achieved by an interchangeable part that enables modification.

However, a problem with such toy tops is that, since the performance is determined by the interchangeable part, the interchangeable part must be changed in order to change the performance.

SUMMARY OF THE INVENTION

The present invention has been made in view of the problem, and an object thereof is to provide a toy top with a performance that changes over time.

In order to realize the above object, according to one aspect of the present invention, there is provided a toy top including:

a body; and a shaft unit, wherein the shaft unit includes a spinning shaft which includes projections that extend downward at a lower end of the spinning shaft.

Since the lower end of the spinning shaft of the shaft unit is composed of the projections that extend downward, the toy top spins on any one of the thin projections, and the individual projections become more likely to wear, fall down, break, etc. through friction, an impact, etc. during landing before a spin starts, or during the spin.

The toy top performs an unstable or irregular spin when some of the projections are lost. In this way, the performance of the toy top is changed over time without any modification. In a match between toy tops, this can make the result more unpredictable and thus make the match very amusing.

Preferably, the projections are arranged along concentric circles that are centered on an axis of the shaft unit.

Since the projections are arranged along the concentric circles which are centered on the axis of the shaft unit, when some projections fall down or are lost, an unstable or irregular spin is readily caused.

Preferably, the projections arranged along the concentric circles are configured such that an inner projection has a greater downward extension.

Since the projections arranged along the concentric circles are configured such that an inner projection has a greater downward extension, the toy top first spins on the projections along a small concentric circle, and when they fall down or are lost, the toy top then spins on the projections along a larger concentric circle. In this way, the spinning manner of the toy top is varied through usage. Therefore, the amusement from the toy top is improved.

Further, a match between toy tops is typically played on a dished board. In such cases, when the inner projections are lost and the outer projections are in contact with the board surface, a toy top moves actively and rapidly as it spins. Therefore, it becomes possible to enjoy a more intense game.

Preferably, at least one of the projections has a triangular cross section in a view from below.

Preferably, at least one of the projections has a polygonal cross section in a view from below.

In these configurations, each of the projections has corners. This makes the projections wear more easily and thus varies the manner of spinning. This brings more amusement. Furthermore, the manner of spinning is varied through falling down, breaking, etc.

Preferably, at least one of the projections has a circular cross section in a view from below.

Preferably, at least one of the projections has an oval cross section in a view from below.

With these configurations, the individual projections are less likely to wear, and the manner of spinning is varied mainly through falling down, breaking, etc. Further, mixing projections likely to wear and projections unlikely to wear makes a mixture of projections with a long life and projections with a short life. This makes a change in the manner of spinning more unpredictable, and brings more amusement.

Preferably, the projections are made of resin.

The projections made of resin are more likely to wear, falling down, break, etc., and the manner of spinning is changed in shorter cycles. This brings more amusement.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein.

DETAILED DESCRIPTION

Hereinafter, embodiments of the present invention will be described with reference to the drawings. Though various technical limitations which are preferable to perform the present invention are included in the after-mentioned embodiments, the scope of the invention is not limited to the following embodiments and the illustrated examples.

General Configuration

Figure 1:
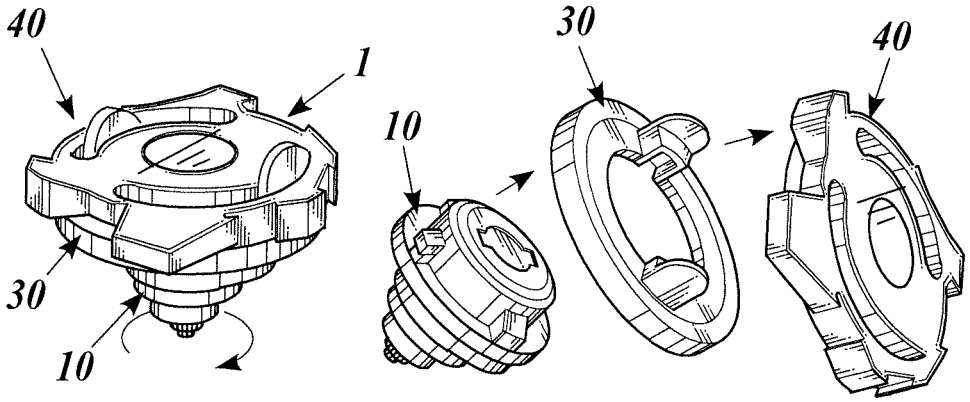
FIG. 1 illustrates how to play a toy top according to an embodiment of the present invention.
Figure 2:
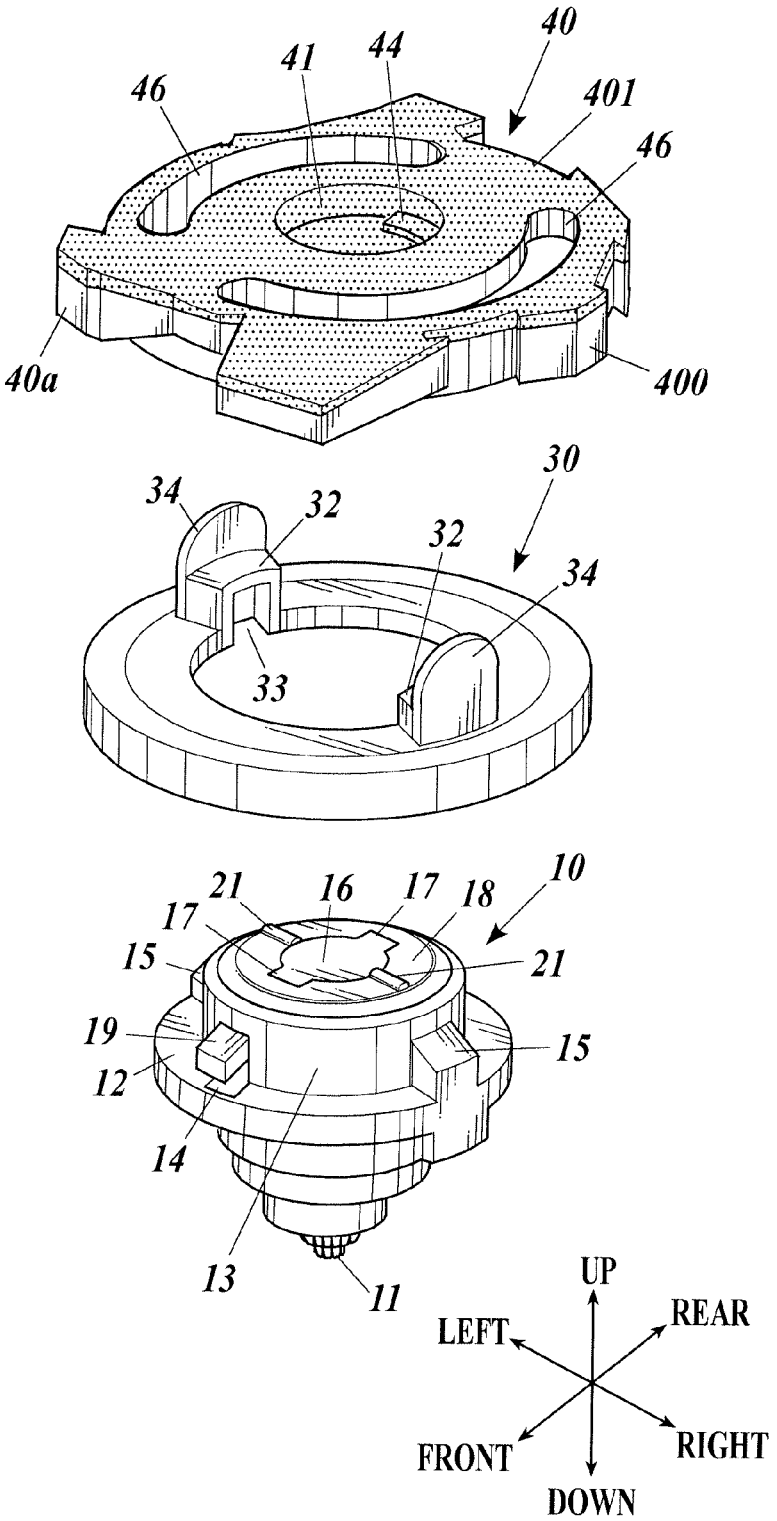
FIG. 2 is an exploded perspective view of the toy top according to the embodiment.
Figure 3:
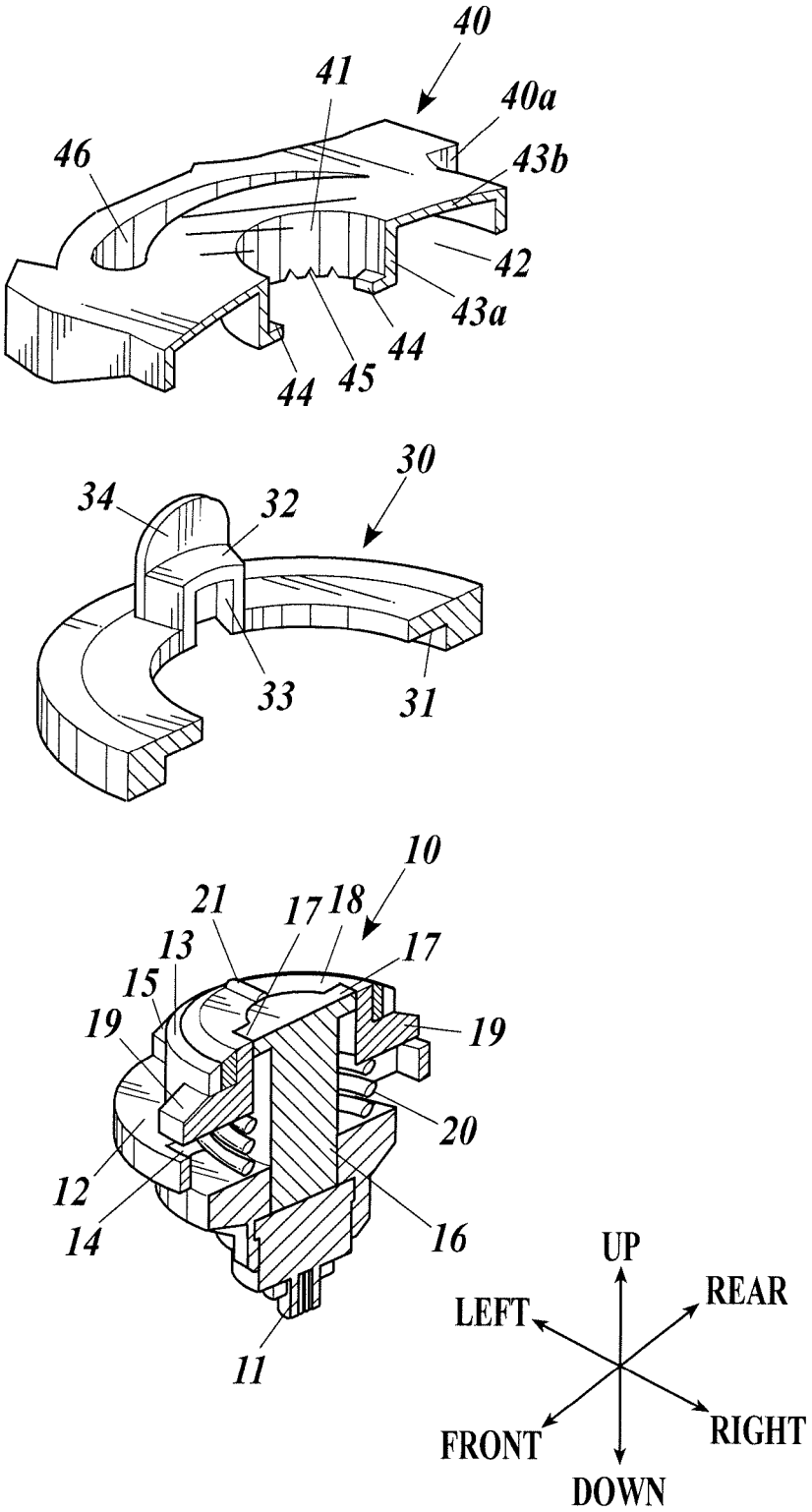
FIG. 3 is an exploded cross sectional perspective view of the toy top according to the embodiment.

FIG. 1 illustrates how to play a toy top according to an embodiment of the present invention, FIG. 2 is an exploded perspective view of the toy top according to the embodiment, and FIG. 3 is an exploded cross sectional perspective view of the toy top according to the embodiment. As used herein, the terms up-down, right-left and front-rear represent the respective directions as illustrated in FIG. 2 and FIG. 3.

The toy top 1 of the embodiment is of a type that can be used in a so-called "top battle game". Specifically, the toy top 1 can be used in a battle game in which a player wins the game when an opponent toy top 1 is disassembled as illustrated in the right part of FIG. 1 by the impact force of a collision between toy tops.

As illustrated in FIG. 2 and FIG. 3, the toy top 1 is composed of a shaft unit 10 as the lower structure, and a performance changing ring 30 and a body 40 as the upper structure.

Detailed Configuration

1. Shaft Unit 10

The shaft unit 10 includes a spinning shaft 11 in the lower part, a flange 12 in the middle part and a cylinder 13 in the upper part. The spinning shaft 11, flange 12 and cylinder 13 are made of synthetic resin. However, the material is not limited to synthetic resin, and at least one or all of them may be made of metal. The spinning shaft 11 is desirably made of a material such as soft synthetic resin or soft metal that is more likely to bend, fall down, break, wear, etc. than other components.

The lower part of the flange 12 narrows stepwise from the flange 12 toward the outer periphery of the spinning shaft 11 and is formed in an approximately inverted conical shape as a whole.

As illustrated in FIG. 2, two holes 14 are formed in the flange 12 and the cylinder 13, which are mutually opposed in the front-rear direction across the axis of the spinning shaft 11. Further, two protrusions 15 are formed in the cylinder 13 and the lower part of the flange 12 which are mutually opposed in the left-right direction across the axis of the spinning shaft 11. The outer faces of the protrusions 15 are flush with the outer peripheral face of the flange 12.

As illustrated in FIG. 3, a cylindrical pillar 16 stands inside the cylinder 13. The upper end of the cylindrical pillar 16 is located higher than the upper end of the cylinder 13, although it is not limited thereto. In the upper end of the cylindrical pillar 16, two hooks (second hooks) 17 are formed which are mutually opposed in the front-rear direction across the axis of the spinning shaft 11 and protrude outward in their respective radial directions.

Figure 4:
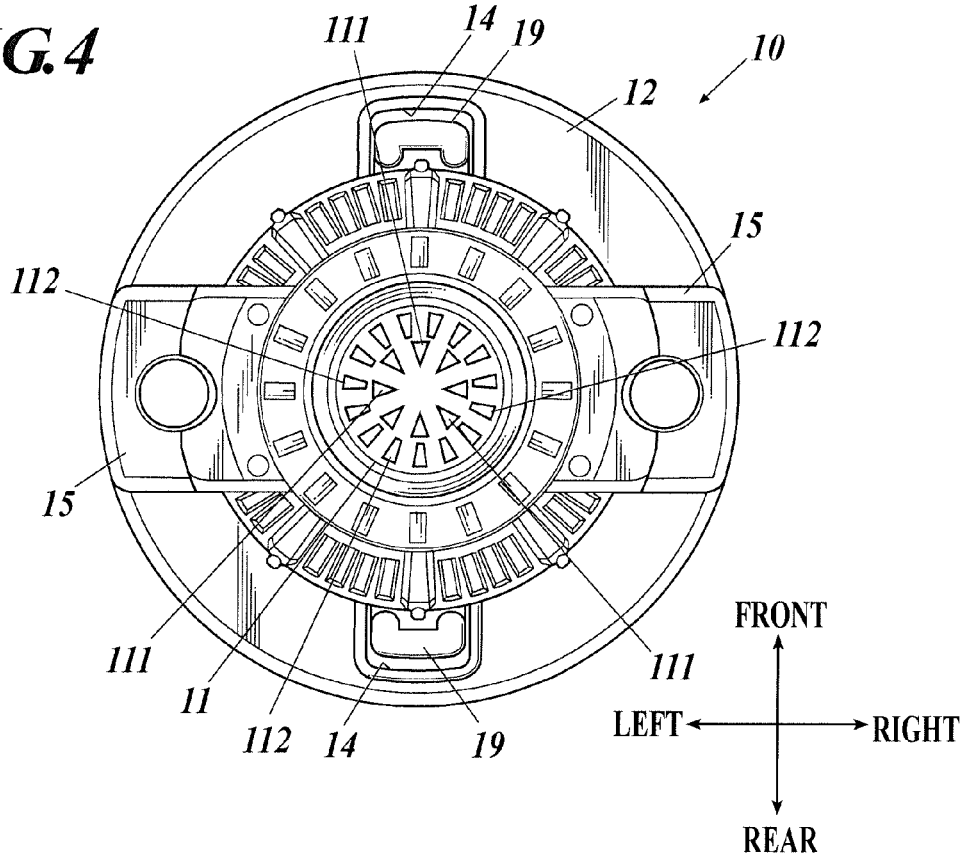
FIG. 4 is a bottom view of a spinning shaft of a shaft unit of the toy top.
Figure 5:
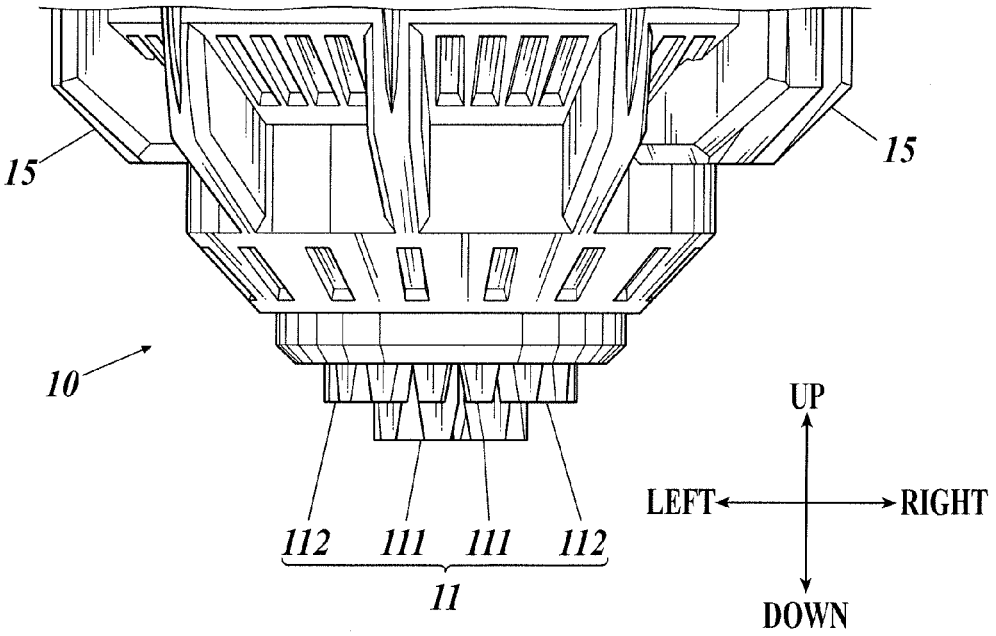
FIG. 5 is a side view of the spinning shaft of the shaft unit of the toy top.
Figure 6:
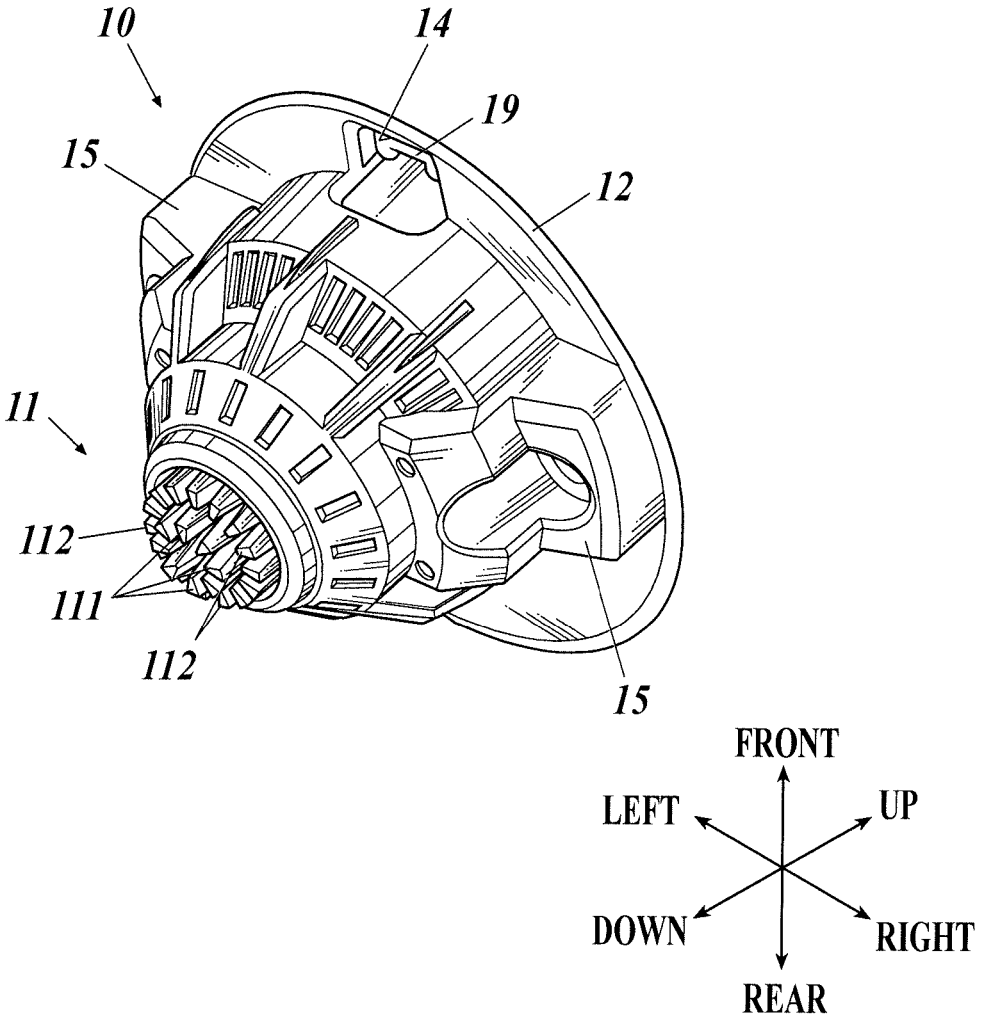
FIG. 6 is a perspective view of the spinning shaft of the shaft unit of the toy top.

FIG. 4 to FIG. 6 are respectively a bottom view, a side view and a perspective view of the spinning shaft 11 of the shaft unit 10. As illustrated in the figures, the lower end of the spinning shaft 11 is composed of downward projections 111, 112, i.e. it is constituted by a set of projections. The projections 111, 112 are arranged along two concentric circles centered on the axis of the shaft unit 10.

On the inner concentric circle, eight projections 111 are arranged at regular intervals, which have an isosceles triangle shape in the bottom view. Each of the projections 111 has an acute vertex that faces the center of the concentric circles.

On the outer concentric circle, fifteen projections 112 are arranged at regular intervals, which have a rectangular wedge shape in the bottom view. Each of the projections 112 has a rectangular wedge shape that narrows toward the center of the concentric circles.

The downward extension of the eight projections 111 arranged along the inner concentric circle is greater than that of the fifteen projections 112 arranged along the outer concentric circle. Accordingly, when the toy top 10 spins in a non-tilted position, the lower ends of the inner projections 111 are mainly in contact with the ground surface.

The above-described numbers of the projections are merely an example and may be suitably changed. Further, the arrangement of the projections is also merely a preferred example and may be suitably changed.

The shaft unit 10 includes a cylindrical movable member 18 that is disposed inside the cylinder 13 and surrounds the upper outer periphery of the cylindrical pillar 16. In the lower end of the outer peripheral face of the movable member 18, two protrusions 19 are formed which are mutually opposed in the front-rear direction across the axis of the spinning shaft 11 and protrude outward in their respective radial directions. As illustrated in FIG. 3, the protrusions 19 are inserted in the holes 14. The movable member 18 is movable in the up-down direction, but the upper edges of the holes 14 limit the upward movement of the movable member 18. The movable member 18 is biased upward by means of a coil spring 20 that is wound around the cylindrical pillar 16. In a normal state, the protrusions 19 are in contact with the upper edges of the holes 14, and the upper end of the movable member 18 is located at the same height as the upper end of the cylinder 13.

On the upper face of the movable member 18, two ridges 21 are formed which are mutually opposed in the right-left direction across the axis of the spinning shaft 11 and extend in their respective radial directions.

2. Performance Changing Ring 30

In the embodiment, the performance changing ring 30 is constituted by a flywheel. The performance changing ring 30 has a plate shape. On the bottom face of the performance changing ring 30, an annular step 31 is formed which can house the flange 12 of the shaft unit 10 from the lower side. Further, on the upper face of the performance changing ring 30, two protrusions 32 are formed which are mutually opposed in the right-left direction across the axis of the spinning shaft 11 and protrude upward. On the lower parts of the protrusions 32, recesses 33 are respectively formed which can house the protrusions 15 of the shaft unit 10 from the lower side. Further, on the upper face of the performance changing ring 30, tongues 34 are formed which extend upward along the outer side of the respective protrusions 32. The tongues 34 protrude higher than the protrusions 32. Alternatively, the performance changing ring 30 may be constituted by a member that includes a protrusion on the outer peripheral face for facilitating an attack on an opponent toy top 1 or a member that includes a recess on the outer peripheral face for averting an attack from the opponent toy top 1. Such a member may be provided instead of or integrally with a flywheel.

3. Body 40

The body 40 has a disk shape. As illustrated in FIG. 2, the body 40 includes a base 400 and a transparent cover 401 that has approximately the same shape as the base 400 in the plan view and is placed on the base 400.

In the outer periphery of the body 40, an uneven pattern **40*a* is formed. Further, at the center of the base 400, a round hole 41 is formed. The upper opening of the round hole 41 is closed by means of the transparent cover 401. In the bottom face of the body 40, a circular recess 42 is formed which can house the protrusions 32 of the performance changing ring 30 from the lower side. The circular recess 42 is defined by an inner peripheral wall 43***a*, and two hooks (first hooks) 44 are disposed on the lower end of the inner peripheral face of the inner peripheral wall 43*a*, which are mutually opposed in the front-rear direction across the axis of the spinning shaft and protrude inward in their respective radial directions. Further, on the lower end face of the inner peripheral wall 43*a*, grooves 45 are formed which extend radially at predetermined intervals in two locations mutually opposed in the right-left direction across the axis of the spinning shaft 11.

Further, the circular recess 42 of the body 40 is also defined by a roof wall 43*b*, and arc slits 46 are formed in the roof wall 43*b*, into which the tongues 34 of the performance changing ring 30 can be inserted from the lower side. The arc slits 46 have such a length that allows the tongues 34 to move an adequate distance.

Assembling Method

Next, an example of the assembling method of the toy top 1 will be described.

Figure 7A:
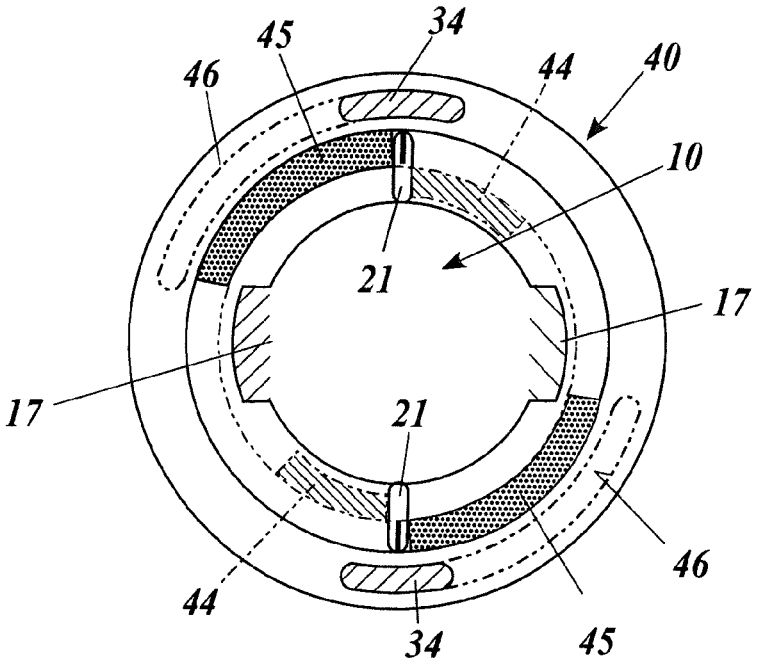
FIG. 7A and FIG. 7B are operation views illustrating the engagement of a shaft unit, a body and a flywheel in the toy top according to the embodiment.
Figure 7B:
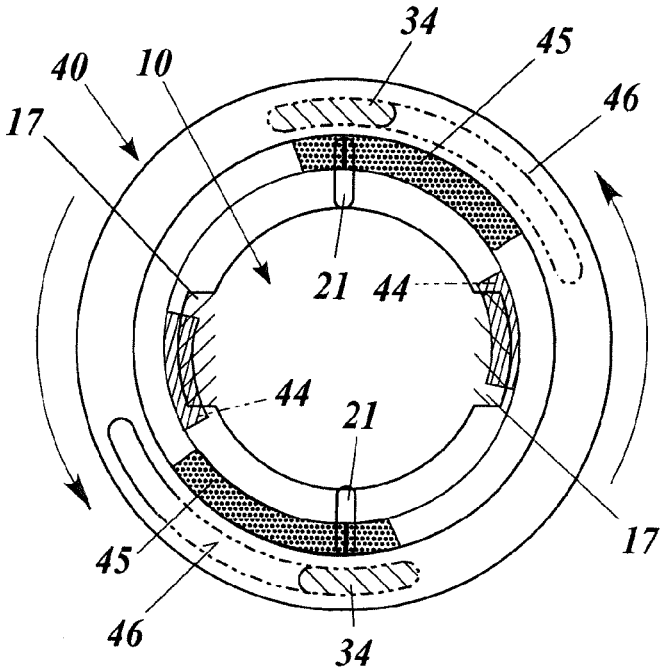

First, the shaft unit 10 is fitted in the performance changing ring 30 from the lower side such that the protrusions 15 of the shaft unit 10 mate with the recesses 33 of the performance changing ring 30. Subsequently, the assembly is brought toward the body 40 from the lower side. In this step, the tongues 34 of the performance changing ring 30 of the assembly are set to predetermined ends of the arc slits 46 of the body 40 (FIG. 7A). In this state, the hooks 17 of the shaft unit 10 do not overlap the hooks 44 of the body 40 in the vertical direction. This state is referred to as a coupling releasable state. Thereafter, the shaft unit 10 of the assembly is pushed toward the body 40. Then the performance changing ring 30 firstly abuts the bottom face of the body 40. When the shaft unit 10 of the assembly is pushed further toward the body 40, the protrusions 19 of the shaft unit 10 are pushed down by the bottom face of the performance changing ring 30 against the biasing force of the coil spring 20. In this state, the hooks 17 of the shaft unit 10 are pushed up higher than the hooks 44 of the body 40. Subsequently, the shaft unit 10 together with the performance changing ring 30 is turned relative to the body 40 until the tongues 34 reach the other ends of the predetermined ends (FIG. 7B). This turn is a relative turn between the assembly of the body 40 and the performance changing ring 30 and the shaft unit 10. FIG. 7B illustrates a state in which the shaft unit 10 has been already turned relative to the body 40 and the performance changing ring 30. After this step, the hooks 17 of the shaft unit 10 are aligned with the hooks 44 of the body 40 in the vertical direction. This state is referred to as a coupling enabled state. When the shaft unit 10 is released, the lower face of the hooks 17 of the shaft unit 10 abuts the upper face of the hooks 44 of the body 40 by the action of the biasing force of the coil spring 20, so that the shaft unit 10, the performance changing ring 30 and the body 40 are coupled with one another. The toy top 1 is thus assembled.

How to Play

Next, an example of how to play the toy top 1 will be described.

In this example, a player spins a toy top 1 to battle with an opponent toy top 1.

Figure 8:
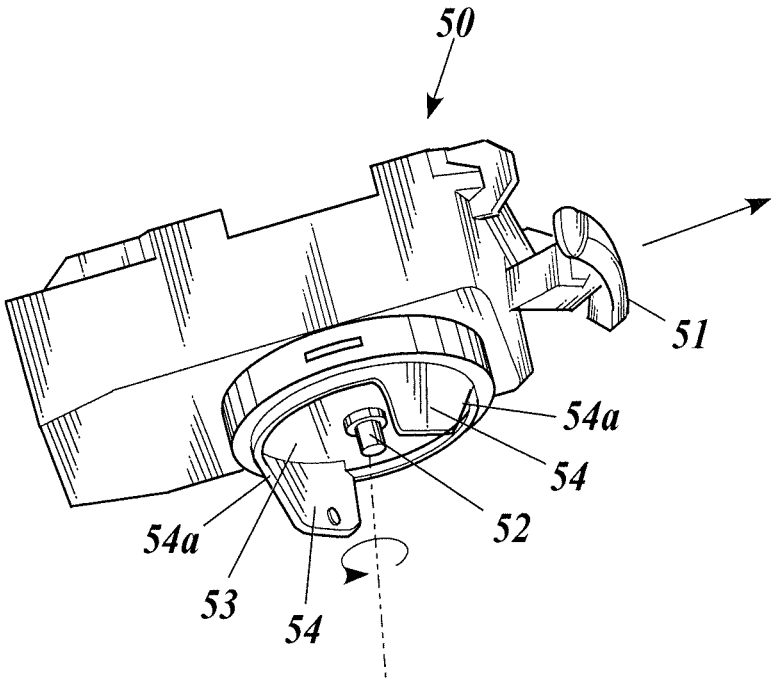
FIG. 8 is a perspective view of an example of a launcher for spinning the toy top according to the embodiment.

In such cases, a launcher 50 as illustrated in FIG. 8 is used to apply a rotary force to the toy top 1. The launcher 50 includes a disk (not shown) therein. The launcher 50 is configured such that when a string (not shown) wound around the disk is pulled by means of a handle 51 while a spiral spring biases the disk in a certain rotational direction, the disk is rotated, and a top holder 53 is rotated accordingly. The rotation of the top holder 53 is transmitted to the toy top 1 through forks 54 that protrude downward, so that the toy top 1 is rotated. When the forks 54 are inserted in the arc slits 46 of the body 40, small protrusions formed on the inner side faces thereof engage with the lower edges of the arc slits 46 so as to hold the toy top 1 and keep it from falling. Then, when the handle 51 of the launcher 50 is completely pulled, the disk and the top holder 53 stop rotating while the toy top 1 continues rotating by the action of its inertial force. Accordingly, the tilted parts of the upper ends of the tongues 34 of the performance changing ring 30 come in contact with the tilted faces 54*a* of the forks 54. This encourages the toy top 1 to move away from the top holder 53, and the toy top 1 thus comes off from the launcher 50 while keeping the rotary force. In FIG. 8, the reference sign 52 denotes a rod that is retractable into the top holder 53. When the toy top 1 is loaded in the top holder 53, the rod 52 is pushed in the top holder 53 by the upper face of the toy top 1. For example, the rod 52 is used for detecting attachment/detachment of the toy top 1.

The toy top 1 thus launched is led to a predetermined field where it spins. When the toy top 1 collides with an opponent toy top 1, the impact or friction of the collision produces a reaction force that acts in the body 40 in the direction opposite to the spinning direction of the shaft unit 10 and the performance changing ring 30 as illustrated in FIG. 7B, and the body 40 thereby relatively turns in the direction opposite to the spinning direction of the shaft unit 10 and the performance changing ring 30.

Then, the ridges 21 of the shaft unit 10 engage with the grooves 45 of the body 40 one after another and are successively held in the respective positions. When the ridges 21 reach the position as illustrated in FIG. 7A, the hooks 44 of the body 40 are released from the hooks 17 of the shaft unit 10 so that the body 40 separates from the shaft unit 10 by the action of the biasing force of the spring 20. Accordingly, the toy top 1 is disassembled as illustrated in the right part of FIG. 1.

In the toy top 1, the lower end of the spinning shaft 11 of the shaft unit 10 is constituted by the projections 111, 112, and the spinning shaft 11 is made of a soft material that is more likely to bend, fall down, break, wear, etc. than the other components.

Accordingly, the individual projections 111, 112 wear, fall down, break, etc. through the friction of a spin, the impact of landing from the launcher 50 and the like. Then they are eventually lost or lose contact with the ground. Further, while the toy top 1 is spinning, the individual projections 111, 112 sometimes wear, fall down, break, etc.

When some of the projections 111, 112 are lost, the toy top 1 spins with only the remaining projections 111, 112 in contact with the ground, which can give instability or irregularity to the spin. In this way, the performance of the toy top 1 can be changed over time through repetitive usages thereof. In a match between toy tops 1, this can make the result unpredictable and thus the match becomes very amusing.

Variations of the Present Invention

While embodiments of the present invention are described, the present invention is not limited to the embodiments, and various changes may be made without departing from the spirit of the present invention.

For example, in one above-described embodiment, the ridges 21 and the grooves 45 are formed respectively in the shaft unit 10 and the body 40 for producing a rotational resistance between the shaft unit 10 and the body 40.

Instead, they may be protrusions and recesses with different shapes. Further, the numbers of them are not limited to those in the above-described embodiment. Alternatively, the rotational resistance may be produced by a rubber or the like formed in the opposed faces of the shaft unit 10 and the body 40. In this case, the shaft unit 10 and the body 40 gradually turn relative to each other in the direction of releasing the coupling by the action of an external impact force or the like.

The above-described embodiments illustrate an example in which the toy top 1 spins in the clockwise direction in the plan view. However, it should be understood well that the present invention is also applicable to a toy top 1 that spins in the anticlockwise direction in the plan view. In this case, in order to produce the toy top 1 that has a structure assembled by turning the body 40 relative to the shaft unit 10 and the performance changing ring 30 in the anticlockwise direction in the plan view, it is only required to change the body 40 while it is possible to use the same shaft unit 10 and the performance changing ring 30.

The above-described embodiments illustrate an example in which a battle is fought between toy tops 1, 1 that spin in the clockwise direction in the plan view. Instead, a battle may be fought between toy tops 1, 1 that spin in the anticlockwise direction in the plan view.

Furthermore, it is also possible that a battle is fought between a toy top 1 that spins in the clockwise direction in the plan view and another toy top 1 that spins in the anticlockwise direction in the plan view.

In this case, a collision and a friction between the toy tops 1, 1 turn the body 40 relative to the shaft unit 10 in the direction from the coupling releasable state to the coupling enabled state. In other words, the body 40 and the shaft unit 10 are turned in the fastening direction thereof. Accordingly, the toy tops 1 are less likely to be disassembled by a collision and a friction. In this case, a battle may be fought with a rule in which a player wins when an opponent toy top 1 is knocked out for example. It is needless to say that a battle may be played among three or more toy tops 1.

The above-described embodiment illustrates an example in which the structure of the spinning shaft 11 as illustrated in FIG. 4 to FIG. 6 is applied to the toy top 1 that is separable into the body 40 and the shaft unit 10 and that is used in a game in which a player wins or loses when they are separated from each other. However, the present invention is not limited thereto.

For example, it goes without saying that the structure of the spinning shaft 11 as illustrated in FIG. 4 to FIG. 6 is applicable to the spinning shaft of a conventional toy top that is used in a game in which spinning toy tops are brought into contact with each other, and a player wins when an opponent toy top is knocked out of a certain field, or when his toy top spins for a longer time.

The above-described embodiments illustrate an example in which the projections 111, 112 of the spinning shaft 11 have a triangular or rectangular shape in the bottom view. However, they may have a different shape such as polygonal shapes with more corners, a circular shape or an oval shape.

This U.S. patent application claims priority to Japanese patent application No. 2016-008042 filed on Jan. 19, 2016, the entire contents of which are incorporated by reference herein.

What is claimed is:

1. A toy top, comprising:

a toy top body having a substantially conical shape with a first narrow end, a second, opposite, broader end, and an axis of rotation, and a shaft extending from the first end of the toy top body, having an axis which corresponds to the axis of rotation of the toy top, and including a spinning surface upon which the toy top spins on a playing surface on the axis of rotation, wherein the shaft includes a plurality of spaced projections extending in the direction of the axis of the shaft, each having a tip and sides extending from the tip, wherein the tips define the spinning surface, wherein the tip of each of the projections can wear due to friction with the playing surface, or each projection can break off from the shaft due to impact with an object, to redefine the spinning surface, and wherein the projections are arranged along concentric circles that are centered on the axis of the shaft.

2. The toy top according to claim 1, wherein the projections arranged along the concentric circles are configured such that at least one of an inner projection extends farther from the toy top than at least one of an outer projection.

3. The toy top according to claim 1, wherein at least one of the projections has a triangular cross section.

4. The toy top according to claim 1, wherein at least one of the projections has a polygonal cross section.

5. The toy top according to claim 1, wherein at least one of the projections has a circular cross section.

6. The toy top according to claim 1, wherein at least one of the projections has an oval cross section.

7. The toy top according to claim 1, wherein the projections are made of resin.

8. The toy top according to claim 1, wherein the toy top body is made of a first material, and the plurality of projections is made of a second, relatively softer material.

9. The toy top according to claim 1, wherein the toy top is made of a metal, and the plurality of projections is made of a second, relatively softer metal.

10. The toy top according to claim 1, wherein the toy top is made of a resin, and the plurality of projections is made of a second, relatively softer resin.

11. A toy top, comprising:

a toy top body having a substantially conical shape with a first narrow end, a second, opposite, broader end and an axis of rotation; and a shaft extending from the first end of the toy top body, having an axis which corresponds to the axis of rotation of the toy top, and including a spinning surface upon which the toy top spins on a playing surface on the axis of rotation, wherein the shaft includes a plurality of spaced projections extending in the direction of the axis of the shaft, each having a tip and sides extending from the tip, wherein the tips define the spinning surface, wherein the tip of each of the projections can wear due to friction with the playing surface, or each projection can break off from the shaft due to impact with an object, to redefine the spinning surface, and wherein at least one of the plurality of projections extends farther from the toy top than at least another of the plurality of projections.

12. The toy top according to claim 11, wherein the projections are arranged along concentric circles that are centered on the axis of the shaft.

13. The toy top according to claim 11, wherein the toy top body is made of a first material, and the plurality of projections is made of a second, relatively softer material.

14. The toy top according to claim 13, wherein the first material is a resin and the second material is a resin.

15. A toy top, comprising:

a toy top body having a substantially conical shape with a first narrow end, a second, opposite, broader end and an axis of rotation; and a shaft extending from the first end of the toy top body, having an axis which corresponds to the axis of rotation of the toy top, and including a spinning surface upon which the toy top spins on a playing surface on the axis of rotation, wherein the shaft includes a plurality of spaced projections extending in the direction of the axis of the shaft, each having a tip and sides extending from the tip, wherein the tips define the spinning surface, wherein the tip of each of the projections can wear due to friction with the playing surface, or each projection can break off from the shaft due to impact with an object, to redefine the spinning surface, wherein the toy top body is made of a first material, and the plurality of projections is made of a second, relatively softer material to allow the projections to wear or break more easily than the toy top body.

16. The toy top according to claim 15, wherein the first material is a resin and the second material is a resin.

17. The toy top as recited in claim 15, wherein at least one of the plurality of projections extends farther from the toy top than at least other of the plurality of projections.

18. The toy top according to claim 17, wherein the projections are arranged along concentric circles that are centered on the axis of the shaft.

* * * * *